US007591708B2

(12) United States Patent
Birang et al.

(10) Patent No.: US 7,591,708 B2
(45) Date of Patent: Sep. 22, 2009

(54) METHOD AND APPARATUS OF EDDY CURRENT MONITORING FOR CHEMICAL MECHANICAL POLISHING

(75) Inventors: Manoocher Birang, Los Gatos, CA (US); Boguslaw A. Swedek, San Jose, CA (US); Hyeong Cheol Kim, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/236,062

(22) Filed: Sep. 26, 2005

(65) Prior Publication Data

US 2006/0025052 A1 Feb. 2, 2006

Related U.S. Application Data

(62) Division of application No. 10/124,507, filed on Apr. 16, 2002, now Pat. No. 7,001,242.

(60) Provisional application No. 60/353,419, filed on Feb. 6, 2002.

(51) Int. Cl.
*B24D 11/00* (2006.01)

(52) U.S. Cl. ..... 451/5; 451/526

(58) Field of Classification Search ..... 451/5, 451/8, 9, 526

See application file for complete search history.

(56) References Cited

U.S. PATENT DOCUMENTS

| | | | |
|---|---|---|---|
| 4,005,359 | A | 1/1977 | Smoot |
| 4,112,365 | A | 9/1978 | Larson et al. |
| 4,272,924 | A | 6/1981 | Masuko et al. |
| 4,303,885 | A | 12/1981 | Davis et al. |
| 4,328,068 | A | 5/1982 | Curtis |
| 4,467,281 | A | 8/1984 | Davis et al. |
| 4,512,847 | A | 4/1985 | Brunsch et al. |
| 4,556,845 | A | 12/1985 | Strope et al. |
| 4,673,877 | A | 6/1987 | Sakamoto et al. |
| 4,715,007 | A | 12/1987 | Fujita et al. |
| 4,716,366 | A | 12/1987 | Hosoe et al. |
| 4,793,895 | A | 12/1988 | Kaanta et al. |
| 4,829,251 | A | 5/1989 | Fischer |

(Continued)

FOREIGN PATENT DOCUMENTS

| | | |
|---|---|---|
| CA | 625 573 | 8/1961 |

(Continued)

OTHER PUBLICATIONS

Henck, S., "In situ real-time ellipsometry for film thickness measurement and control", Jul. /Aug. 1992, J. Vac. Sci. Technology A. vol. 10, No. 4, pp. 934-938.

(Continued)

*Primary Examiner*—Jacob K Ackun, Jr.
(74) *Attorney, Agent, or Firm*—Fish & Richardson

(57) ABSTRACT

A polishing system can have a rotatable platen, a polishing pad secured to the platen, a carrier head to hold a substrate against the polishing pad, and an eddy current monitoring system including a coil or ferromagnetic body that extends at least partially through the polishing pad. A polishing pad can have a polishing layer and a coil or ferromagnetic body secured to the polishing layer. Recesses can be formed in a transparent window in the polishing pad.

18 Claims, 6 Drawing Sheets

U.S. PATENT DOCUMENTS 4,907,615 A * 3/1990 Meyer et al. ..... 137/1
4,948,259 A 8/1990 Enke et al.
4,954,142 A 9/1990 Carr et al.
5,003,262 A 3/1991 Egner et al.
5,081,421 A 1/1992 Miller et al.
5,081,796 A 1/1992 Schultz
5,097,430 A 3/1992 Birang
5,132,617 A 7/1992 Leach et al.
5,196,353 A 3/1993 Sandhu et al.
5,213,655 A 5/1993 Leach et al.
5,219,787 A 6/1993 Carey et al.
5,234,868 A 8/1993 Cote
5,237,271 A 8/1993 Hedengren
5,240,552 A 8/1993 Yu et al.
5,242,524 A 9/1993 Leach et al.
5,257,478 A 11/1993 Hyde et al.
5,265,378 A 11/1993 Rostoker
5,294,289 A 3/1994 Heinz et al.
5,308,438 A 5/1994 Cote et al.
5,321,304 A 6/1994 Rostoker
5,332,467 A 7/1994 Sune et al.
5,337,015 A 8/1994 Lustig et al.
5,343,146 A 8/1994 Koch et al.
5,355,083 A 10/1994 George et al.
5,395,801 A 3/1995 Doan et al.
5,433,651 A 7/1995 Lustig
5,489,233 A 2/1996 Cook
5,541,510 A 7/1996 Danielson
5,559,428 A 9/1996 Li et al.
5,575,707 A * 11/1996 Talieh et al. ..... 451/173
5,605,760 A 2/1997 Roberts
5,609,511 A 3/1997 Moriyama et al.
5,643,044 A 7/1997 Lund
5,644,221 A 7/1997 Li et al.
5,659,492 A 8/1997 Li et al.
5,660,672 A * 8/1997 Li et al. ..... 156/345.13
5,663,637 A 9/1997 Li et al.
RE35,703 E 12/1997 Koch et al.
5,731,697 A 3/1998 Li et al.
5,770,948 A 6/1998 Li et al.
5,838,447 A 11/1998 Hiyama
5,889,401 A 3/1999 Jourdain et al.
5,893,796 A 4/1999 Birang et al.
5,942,893 A 8/1999 Terpay
5,948,697 A * 9/1999 Hata ..... 438/690
5,949,927 A 9/1999 Tang
5,964,643 A 10/1999 Birang
6,004,187 A 12/1999 Nyui et al.
6,045,439 A 4/2000 Birang et al.
6,068,539 A 5/2000 Bajaj et al.
6,072,313 A 6/2000 Li et al.
6,146,242 A * 11/2000 Treur et al. ..... 451/6
6,146,248 A 11/2000 Jaraith
6,179,709 B1 1/2001 Redeker
6,248,000 B1 6/2001 Aiyer
6,248,130 B1 6/2001 Perry
6,254,459 B1 * 7/2001 Bajaj et al. ..... 451/41
6,280,290 B1 8/2001 Birang
6,309,276 B1 10/2001 Tsai et al.
6,428,386 B1 8/2002 Bartlett
6,433,541 B1 8/2002 Lehman et al.
6,524,164 B1 2/2003 Tolles
6,537,133 B1 3/2003 Birang
6,558,229 B2 5/2003 Kimura et al.
6,586,337 B2 7/2003 Parikh
6,599,765 B1 7/2003 Boyd et al.
6,602,724 B2 8/2003 Redeker et al.
6,621,264 B1 9/2003 Lehman et al.
6,663,469 B2 12/2003 Kimura et al.
6,707,540 B1 3/2004 Lehman et al.
6,741,076 B2 5/2004 Le
2002/0016145 A1 * 2/2002 Tominaga et al. ..... 451/526
2002/0047705 A1 * 4/2002 Tada et al. ..... 324/230
2002/0077031 A1 6/2002 Johansson et al.
2002/0090887 A1 * 7/2002 Halley et al. ..... 451/6
2002/0098777 A1 * 7/2002 Laursen et al. ..... 451/6
2002/0115379 A1 8/2002 Sevilla et al.
2002/0164925 A1 * 11/2002 Swedek et al. ..... 451/5
2002/0173231 A1 11/2002 Hasegawa
2003/0201769 A1 10/2003 Hanawa et al.
2003/0201770 A1 10/2003 Hanawa et al.
2003/0236055 A1 12/2003 Swedek et al.
2005/0060943 A1 3/2005 Turner

FOREIGN PATENT DOCUMENTS

EP 0 352 740 1/1990
EP 0 460 348 A 12/1991
EP 468 897 1/1992
EP 0 663 265 7/1995
EP 073 8561 10/1996
EP 0881 040 12/1998
EP 0881 484 12/1998
EP 1116552 A 7/2001
FR 1 075 634 10/1954
JP 57-138575 8/1982
JP S57-138575 8/1982
JP S58-4353 1/1983
JP 59-74635 4/1984
JP 61-164773 7/1986
JP S62-190728 8/1987
JP 62-283678 9/1987
JP S62-211927 9/1987
JP 63-256344 10/1988
JP 259938 6/1989
JP H2-222533 9/1990
JP 03-234467 10/1991
JP 3-234467 10/1991
JP 05-138531 6/1993
JP H5-138531 6/1993
JP 05-309558 11/1993
JP 60-037076 2/1994
JP 07-052032 2/1995
JP 09-036072 2/1997
WO WO93/20976 10/1993
WO WO 01/46684 6/2001
WO WO 0189765 A 11/2001
WO WO 02087825 A 11/2002

OTHER PUBLICATIONS

Sautter et al., "Development Process Control and Optimization Utilizing and End Point Monitor", 1989, SPIE vol. 1087, pp. 312-321.
Jurczyk et al., "Process Detection System", Nov. 1975, IBM Technical Disclosure Bulletin, vol. 18 No. 6, pp. 1867-1870.
Carotta et al., "Effect of Thickness and Surface Treatment on Silicon Water Reflectance", 1992, Solar Energy Materials and Solar Cells 27, pp. 265-272.
Nakamura et al., "Mirror Polishing of Silicon Wafers, 4th Report, Development of Bowl Feed and Double Side Polishing Machine with In-Situ Thickness Monitoring of Silicon Wafers", 1993, pp. 129-134.
Anonymous, "End-Point Detection of Oxide Polishing and Planarization of Semiconductor Devices", Aug. 1992, Research Disclosure, No. 340.

* cited by examiner

"Horse Shoe 1"

"Horse Shoe 2"

"Horse Shoe 3"

METHOD AND APPARATUS OF EDDY CURRENT MONITORING FOR CHEMICAL MECHANICAL POLISHING

CROSS-REFERENCE TO RELATED APPLICATIONS

This application is a divisional application and claims the benefit of priority under 35 U.S.C. Section 120 of U.S. application Ser. No. 10/124,507, filed on Apr. 16, 2002, which issued on Feb. 1, 2006, as U.S. Pat. No. 7,001,242 and claims priority to U.S. Provisional Application Ser. No. 60/353,419, filed on Feb. 6, 2002. The disclosure of each prior application is considered part of and is incorporated by reference in the disclosure of this application.

BACKGROUND

This present invention relates to methods and apparatus for monitoring a metal layer during chemical mechanical polishing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment media. The carrier head provides a controllable load on the substrate to push it against the polishing pad. A polishing slurry, including at least one chemically-reactive agent, and abrasive particles if a standard pad is used, is supplied to the surface of the polishing pad.

One problem in CMP is determining whether the polishing process is complete, i.e., whether a substrate layer has been planarized to a desired flatness or thickness, or when a desired amount of material has been removed. Overpolishing (removing too much) of a conductive layer or film leads to increased circuit resistance. On the other hand, under-polishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

One way to determine the polishing endpoint is to monitor polishing of the substrate in-situ, e.g., with optical or electrical sensors. One monitoring technique is to induce an eddy current in the metal layer with a magnetic field, and detect changes in the magnetic flux as the metal layer is removed. In brief, the magnetic flux generated by the eddy current is in opposite direction to the excitation flux lines. This magnetic flux is proportional to the eddy current, which is proportional to the resistance of the metal layer, which is proportional to the layer thickness. Thus, a change in the metal layer thickness results in a change in the flux produced by the eddy current. This change in flux induces a change in current in the primary coil, which can be measured as change in impedance. Consequently, a change in coil impedance reflects a change in the metal layer thickness.

SUMMARY

In one aspect, the invention is directed to a polishing system that has a polishing pad with a polishing surface, a carrier to hold a substrate against the polishing surface of the polishing pad, and an eddy current monitoring system including a coil. The coil is positioned on a side of the polishing surface opposite the substrate and extends at least partially through the polishing pad.

Implementations of the invention may include one or more of the following features. The polishing pad may include a recess formed in a bottom surface thereof, and the coil may be at least partially positioned into the recess. The coil is secured to the polishing pad, e.g., embedded in the polishing pad. The coil may be wound about the core. The coil may extend at least partially through a transparent window of an optical monitoring system. The polishing pad may be mounted on a top surface of a platen, and the coil may be supported by the platen.

In another aspect, the invention is directed to a polishing system that has a polishing pad with a polishing surface, a carrier to hold a substrate against the polishing surface of the polishing pad, and an eddy current monitoring system including a ferromagnetic body. The ferromagnetic body is positioned on a side of the polishing surface opposite the substrate and extends at least partially through the polishing pad.

Implementations of the invention may include one or more of the following features. A recess may be formed in a bottom surface of the polishing pad, and the ferromagnetic body may be positioned into the recess. The polishing pad may be attached to a platen, and the ferromagnetic body may be supported by the platen. A gap may separate the ferromagnetic body from the polishing pad. The polishing pad may include an aperture formed therethrough, and the ferromagnetic body may be positioned in the aperture. A core of the eddy current monitoring system may be aligned with the ferromagnetic body when the polishing pad is secured to the platen. The ferromagnetic body may extend at least partially through a transparent window of an optical monitoring system. The ferromagnetic body may be secured to the polishing pad, e.g., with a polyurethane epoxy or embedded in the polishing pad. A coil may be wound around the ferromagnetic body. The coil may extend at least partially through the polishing pad. The ferromagnetic body may be biased against the polishing pad.

In another aspect, the invention is directed to a polishing system that includes a polishing pad having a polishing surface and a backing surface with a recess formed therein, and an eddy current monitoring system including an induction coil positioned at least partially in the recess.

In another aspect, the invention is directed to a polishing system that includes a polishing pad having a polishing surface and a backing surface with a recess formed therein, and an eddy current monitoring system including a ferromagnetic body positioned at least partially in the recess.

In another aspect, the invention is directed to a polishing pad that has a polishing layer with a polishing surface and a solid transparent window in the polishing layer. The transparent window has top surface that is substantially flush with the polishing surface and a bottom surface with at least one recess formed therein.

Implementations of the invention may include one or more of the following features. The transparent window may be formed of polyurethane. A backing layer may be positioned on a side of the polishing layer opposite the polishing surface. An aperture may be formed in the backing layer and aligned with the window.

In another aspect, the invention is directed to a polishing pad that has a polishing layer and an induction coil secured to the polishing layer.

Implementations of the invention may include one or more of the following features. The induction coil may be embedded in the polishing pad. A recess may be formed in a bottom surface of the polishing pad, and the coil may be positioned into the recess. The coil may be positioned with a primary axis perpendicular to a surface of the polishing layer. The coil may be positioned with a primary axis at an angle greater than 0 and less than 90 degrees to a surface of the polishing layer.

In another aspect, the invention is directed to a polishing pad with a polishing layer and a ferromagnetic body secured to the polishing layer.

Implementations of the invention may include one or more of the following features. The polishing layer may include a recess formed in a bottom surface thereof, and the ferromagnetic body may be positioned into the recess. The polishing layer may include a plurality of recesses, and a plurality of ferromagnetic bodies may be positioned into the recesses. The polishing layer may include an aperture formed therethrough, and the ferromagnetic body may be positioned in the aperture. A plug may hold the ferromagnetic body in the aperture. The plug may have a top surface substantially flush with a surface of the polishing layer. A position of the ferromagnetic body may be adjustable relative to a surface of the polishing layer. A top surface of the ferromagnetic body may be exposed to the polishing environment. The ferromagnetic body may be positioned with a longitudinal axis perpendicular to a surface of the polishing layer, or the ferromagnetic body may be positioned with a longitudinal axis at an angle greater than 0 and less than 90 degrees to a surface of the polishing layer. The ferromagnetic body may be secured to the polishing layer with an epoxy. A transparent window may be formed through the polishing layer, and the ferromagnetic body may be secured to the transparent window. A recess or aperture may be formed in the transparent window. A coil may be wound around the ferromagnetic body.

In another aspect, the invention is directed to a carrier head for a polishing system that has a substrate receiving surface and a ferromagnetic body behind the substrate receiving surface.

In another aspect, the invention is directed to a method of polishing. The method includes bringing a substrate into contact with a polishing surface of a polishing pad, positioning an induction coil on a side of the polishing surface opposite the substrate so that the induction coil extends at least partially through the polishing pad, causing relative motion between the substrate and the polishing pad, and monitoring a magnetic field using the induction coil.

In another aspect, the invention is directed to a method of polishing. The method includes bringing a substrate into contact with a polishing surface of a polishing pad, positioning a ferromagnetic body on a side of the polishing surface opposite the substrate so that the ferromagnetic body extends at least partially through the polishing pad, causing relative motion between the substrate and the polishing pad, and monitoring a magnetic field using an induction coil that is magnetically coupled to the ferromagnetic body.

In another aspect, the invention is directed to a method of manufacturing a polishing pad. The method includes forming a recess in a bottom surface of a solid transparent window, and installing the solid transparent window in a polishing layer so that a top surface of the solid transparent window is substantially flush with a polishing surface of the polishing pad.

Implementations of the invention may include one or more of the following features. Forming the recess may include machining the recess or molding the window. Installing the window may includes forming an aperture in the polishing layer and securing the window in the aperture, e.g., with an adhesive.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1A:
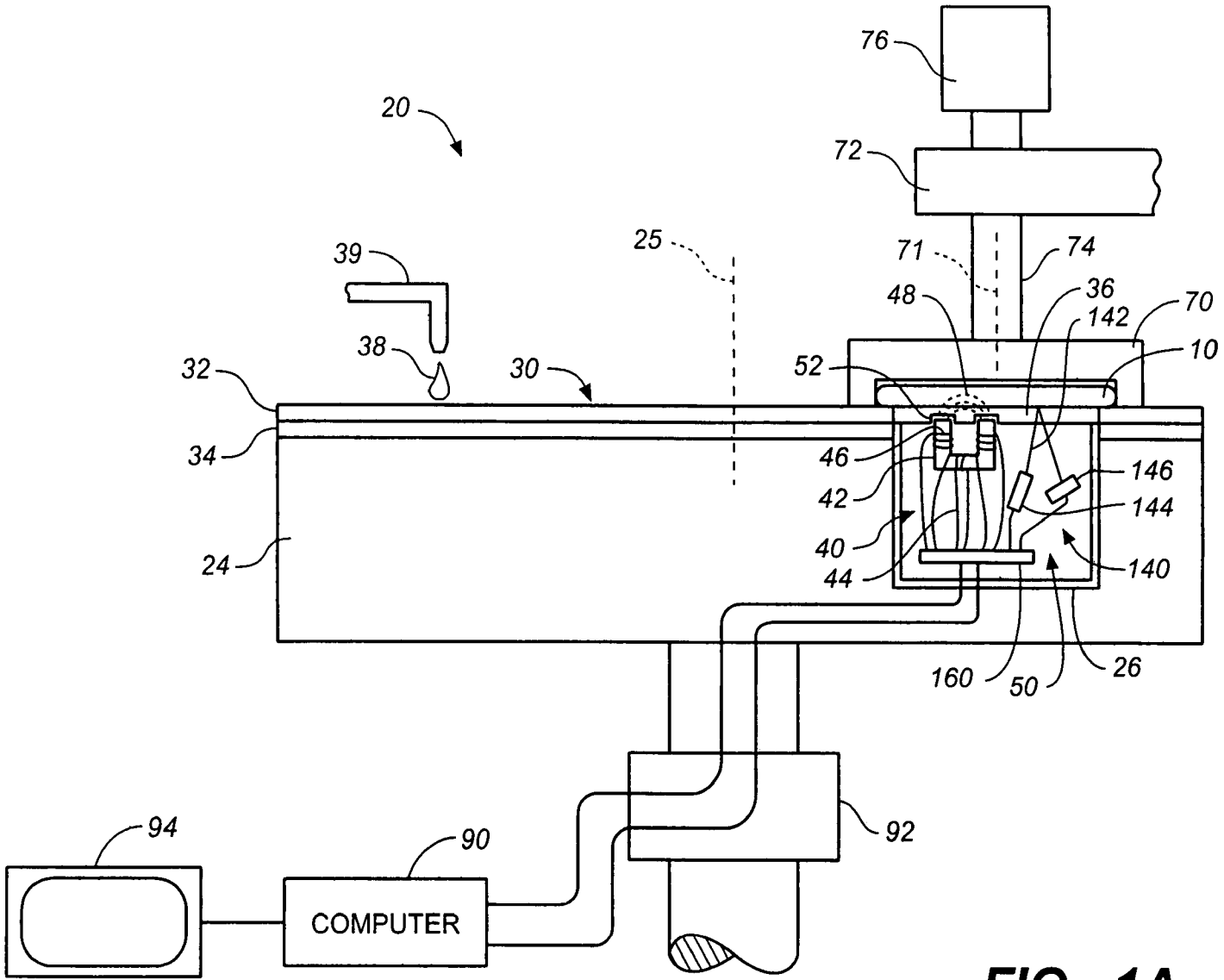
FIG. 1A is a schematic side view, partially cross-sectional, of a chemical mechanical polishing station that includes an eddy current monitoring system and an optical monitoring system.

Referring to FIG. 1A, one or more substrates 10 can be polished by a CMP apparatus 20. A description of a suitable polishing apparatus 20 can be found in U.S. Pat. No. 5,738,574, the entire disclosure of which is incorporated herein by reference.

The polishing apparatus 20 includes a rotatable platen 24 on which is placed a polishing pad 30. The polishing pad 30 can be a two-layer polishing pad with a hard durable outer layer 32 and a soft backing layer 34. The polishing station can also include a pad conditioner apparatus to maintain the condition of the polishing pad so that it will effectively polish substrates.

During a polishing step, a slurry 38 containing a liquid and a pH adjuster can be supplied to the surface of polishing pad 30 by a slurry supply port or combined slurry/rinse arm 39. Slurry 38 can also include abrasive particles.

The substrate 10 is held against the polishing pad 30 by a carrier head 70. The carrier head 70 is suspended from a support structure 72, such as a carousel, and is connected by a carrier drive shaft 74 to a carrier head rotation motor 76 so that the carrier head can rotate about an axis 71. In addition, the carrier head 70 can oscillate laterally in a radial slot formed the support structure 72. A description of a suitable carrier head 70 can be found in U.S. patent application Ser. Nos. 09/470,820 and 09/535,575, filed Dec. 23, 1999 and Mar. 27, 2000, the entire disclosures of which are incorporated by reference. In operation, the platen is rotated about its central axis 25, and the carrier head is rotated about its central axis 71 and translated laterally across the surface of the polishing pad.

A recess 26 is formed in platen 24, and an in-situ monitoring module 50 fits into the recess 26. A transparent window 36 fits over a portion of the module 50. The transparent window 36 has a top surface that lies flush with the top surface of the polishing pad 30. The module 50 and window 36 are positioned such that they pass beneath substrate 10 during a portion of the platen's rotation.

The transparent window 36 can be an integral part of the module 50 itself, or it can be an integral part of the polishing pad 30. In the former case, the polishing pad can be formed with an aperture that matches the dimension of the window. When the polishing pad is installed, the aperture fits around the window. In the later case, the polishing pad can be placed on platen 24 so that the window is aligned with the module 50. The transparent window 36 can be a relatively pure polymer or polyurethane, e.g., formed without fillers, or the window can be formed of Teflon or a polycarbonate. In general, the material of the window 36 should be non-magnetic and non-conductive.

The in-situ monitoring module 50 includes an situ eddy current monitoring system 40 and an optical monitoring system 140. The optical monitoring system 140, which will not be described in detail, includes a light source 144, such as a laser, and a detector 146. The light source generates a light beam 142 which propagates through transparent window 36 and slurry to impinge upon the exposed surface of the substrate 10. Light reflected by the substrate is detected by the detector 146. In general, the optical monitoring system functions as described in U.S. patent application Ser. No. 09/184,775, filed Nov. 2, 1998, and Ser. No. 09/184,767, filed Nov. 2, 1998, the entire disclosures of which are incorporated herein by references.

The eddy current monitoring system 40 includes a core 42 positioned in the recess 26 to rotate with the platen. A drive coil 44 is wound around a first part of the core 42, and a sense coil 46 wound around a second part of the core 42. In operation, an oscillator energizes the drive coil 44 to generate an oscillating magnetic field 48 that extends through the body of core 42. At least a portion of magnetic field 48 extends through the window 36 toward the substrate 10. If a metal layer is present on the substrate 10, the oscillating magnetic field 48 will generate eddy currents. The eddy current produces a magnetic flux in the opposite direction to the induced field, and this magnetic flux induces a back current in the primary or sense coil in a direction opposite to the drive current. The resulting change in current can be measured as change in impedance of the coil. As the thickness of the metal layer changes, the resistance of the metal layer changes. Therefore, the strength of the eddy current and the magnetic flux induced by eddy current also change, resulting in a change to the impedance of the primary coil. By monitoring these changes, e.g., by measuring the amplitude of the coil current or the phase of the coil current with respect to the phase of the driving coil current, the eddy current sensor monitor can detect the change in thickness of the metal layer.

The drive system and sense system for the eddy current monitoring system will not be described in detail, as descriptions of suitable systems can be found in U.S. patent application Ser. Nos. 09/574,008, 09/847,867, and 09/918,591, filed Feb. 16, 2000, May 2, 2001, and Jul. 27, 2001, respectively, the entire disclosures of which are incorporated by reference.

Various electrical components of the optical and eddy-current monitoring systems can be located on a printed circuit board 160 located in the module 50. The printed circuit board 160 can include circuitry, such as a general purpose microprocessor or an application-specific integrated circuit, to convert the signals from the eddy current sensing system and optical monitoring system into digital data.

As previously noted, the eddy current monitoring system 40 includes a core 42 positioned in the recess 26. By positioning the core 42 close to the substrate, the spatial resolution of the eddy current monitoring system can be improved.

Referring to FIG. 1A, the core 42 can be a U-shaped body formed of a non-conductive ferromagnetic material, such as ferrite. The drive coil 44 is wound around a bottom rung of the core 42, and the sense coils 46 are wound around the two prongs 42*a* and 42*b* of the core 42. In an exemplary implementation, each prong can have a cross-section of about 4.3 mm by 6.4 mm and the prongs can be about 20.5 mm apart. In another exemplary implementation, each prong can have a cross-section of about 1.5 mm by 3.1 mm and the prongs can be about 6.3 mm apart. A suitable size and shape for the core can be determined experimentally. However, it should be noted that by reducing the size of the core, the resulting magnetic fields can be smaller and will cover a smaller area on the substrate. Consequently, the spatial resolution of the eddy current monitoring system can be improved. A suitable winding configuration and core composition can also be determined experimentally.

The lower surface of the transparent window 36 includes two rectangular indentations 52 that provide two thin sections 53 in the polishing pad. The prongs 42*a* and 42*b* of the core 42 extend into the indentations 52 so that they pass partially through the polishing pad. In this implementation, the polishing pad can be manufactured with recesses preformed in the lower surface of the window. When the polishing pad 30 is secured to the platen, the window 36 fits over the recess 26 in the platen and the recesses 52 fit over the ends of the prongs of the core. Thus, the core can be held by a support structure so that the prongs 42*a* and 42*b* actually project beyond the plane of the top surface of the platen 24. By positioning the core 42 closer to the substrate, there is less spread of the magnetic fields, and spatial resolution can be improved.

The recesses can be formed by machining the recesses into the bottom surface of the solid window piece, or by molding the window with the recesses, e.g., by injection molding or compression molding so that the window material cures or sets in mold with an indentation that forms the recess. Once the window has been manufactured, it can be secured in the polishing pad. For example, an aperture can be formed in the upper polishing layer, and the window can be inserted into the aperture with an adhesive, such as a glue or adhesive. Alternatively, the window could be inserted into the aperture, a liquid polyurethane could be poured into the gap between the window and pad, and the liquid polyurethane could be cured. Assuming that the polishing pad includes two layers, an aperture can be formed in the backing layer that aligns with the window 36, and the bottom of the window could be attached to the exposed edges of the backing layer with an adhesive.

Figure 2:
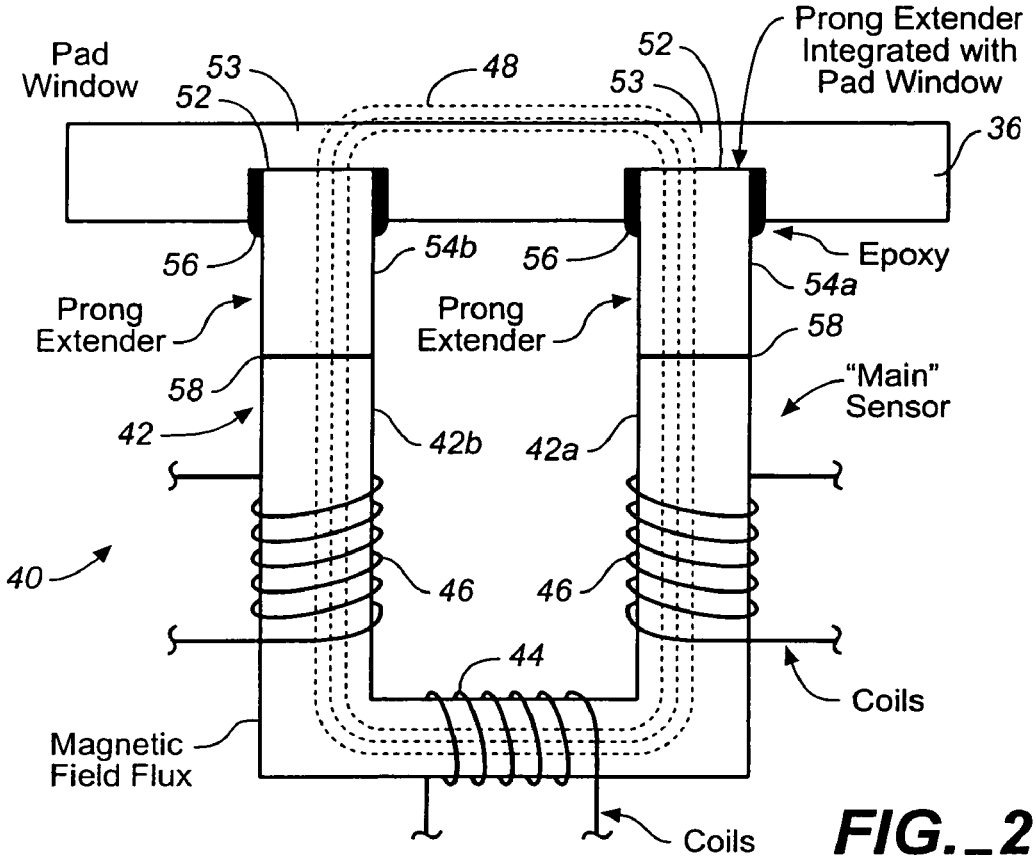
FIG. 2 is a schematic cross-sectional side view illustrating ferromagnetic pieces secured to the polishing pad.

Referring to FIG. 2, in another implementation, one or more ferromagnetic pieces are secured to the polishing pad, potentially during manufacturing of the pad. The lower surface of the transparent window 36 includes two rectangular indentations 52, and two prong extenders 54*a* and 54*b* are secured in the indentations 52, e.g., by an epoxy 56. The prong extenders 54*a* and 54*b* have substantially the same cross-sectional dimensions as the prongs 42*a* and 42*b* of the core 42. The prong extenders 54*a* and 54*b* are formed of a ferromagnetic material, which can be same material as the core 42. When the window 36 is secured over the module 40, the prong extenders 54*a* and 54*b* are substantially aligned and in close proximity to the prongs 42*a* and 42*b*. Thus, the prong extenders 54*a* and 54*b* funnel the magnetic field 48 through the thin sections 53 of the window 36 so that the core is effectively positioned closer to the substrate. A small gap 58 can separate the prongs from the prong extenders without adversely affecting the performance of the eddy current monitoring system.

Figure 3:
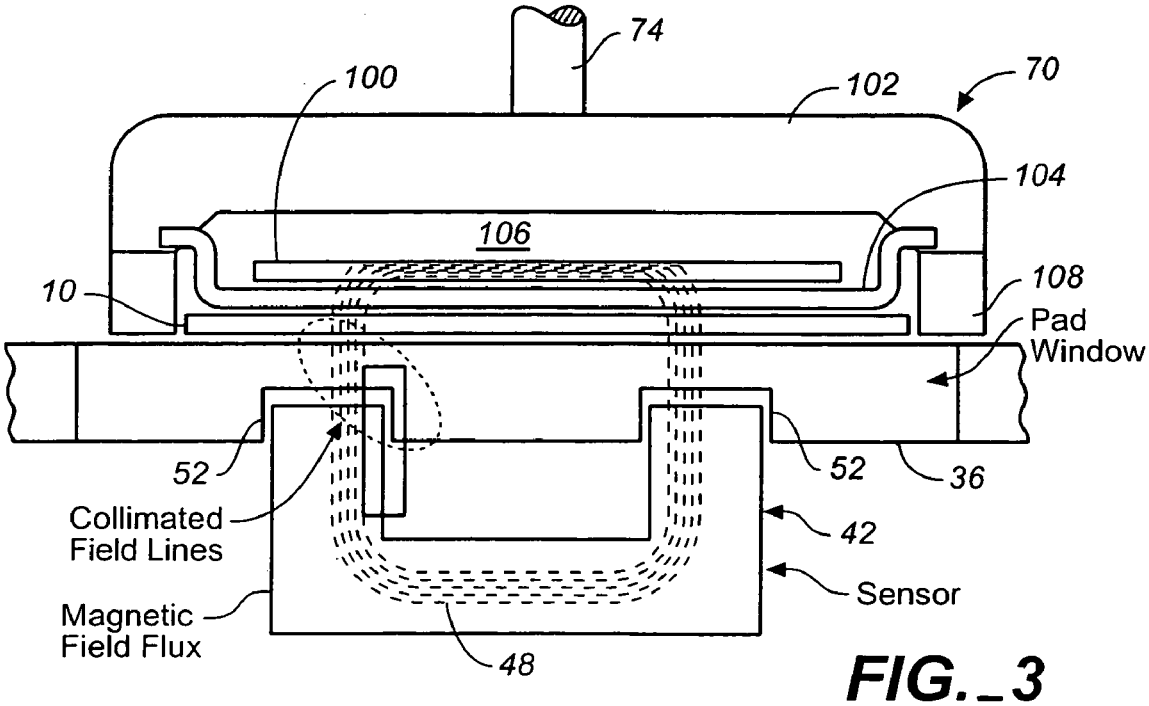
FIG. 3 is a schematic cross-sectional side view illustrating a carrier head modified to channel magnetic fields generated by an eddy current monitoring system.

Referring to FIG. 3, in another implementation, the carrier head 70 is modified so that the magnetic field lines are more concentrated or collimated as they pass through the substrate 10. As shown, the carrier head 70 includes a base 102, a flexible membrane 104 that is secured to the base 102 to form a pressurizable chamber 106, and a retaining ring 108 to hold the substrate below the membrane 104. By forcing fluid into the chamber 106, the membrane 104 is pressed downwardly, applying a downward load on the substrate 10.

The carrier head 70 also includes a plate 100 formed of a ferromagnetic material, such as ferrite. The plate 100 can be positioned inside the pressurizable chamber 106, and can rest on the flexible membrane 104. Because the plate 100 is more magnetically permeable than the surrounding carrier head, the magnetic field is channeled preferentially through the plate and the magnetic field lines remain relatively concentrated or collimated as they pass through the substrate 10. Consequently, the magnetic field passes through a relatively small portion of the substrate, thereby improving the spatial resolution of the eddy current monitoring system 40.

Alternatively, instead of a flexible membrane and a pressurizable chamber, the carrier head can use a rigid backing member that is formed of a ferromagnetic material. A thin compressible layer, such as a carrier film, can be placed on the outer surface of the rigid backing member.

Figure 4:
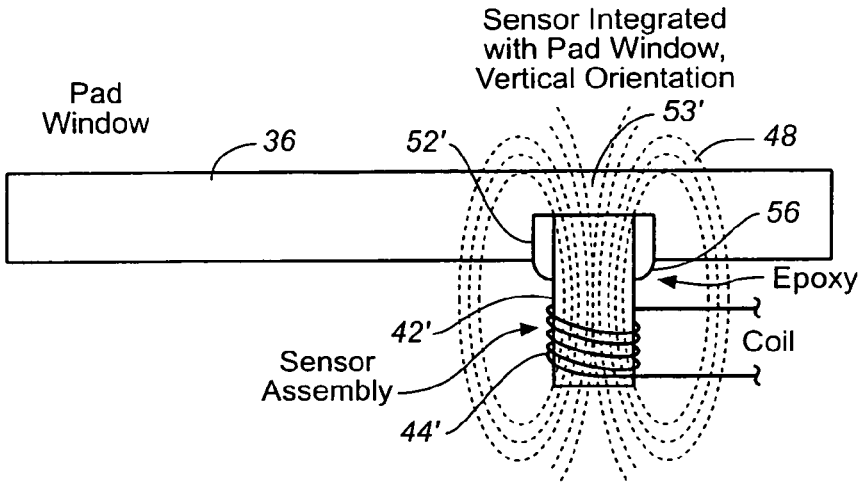
FIG. 4 is a schematic cross-sectional side view illustrating a rod-shaped core secured in a recess in a transparent window of a polishing pad.

Referring to FIG. 4, in another implementation, the core 42' is a simple ferromagnetic rod instead of a U-shaped body. In one exemplary implementation, the core 42' is a cylinder about 1.6 mm and about 5 mm long. Optionally, the core 42' can have a trapezoidal cross-section. A combined drive and sense coil 44' can be wound around the bottom of the core 42'. Alternatively, separate drive and sense coils can both be wound around the core 42'.

The core 42' is oriented substantially vertically, i.e., with its longitudinal axis relatively perpendicular to the plane of the polishing surface. The window 36 includes a single indentation 52', and the core 42' can be secured so that a portion of the core 42' extends into the indentation 52'. When the drive and sense coil 44' is energized, the magnetic field passes through the thin section 53' to interact with the metal layer on the substrate. The core 42' can be secured with an epoxy, such as polyurethane epoxy, or by using a liquid polyurethane and curing the polyurethane with the core in place.

The coil 44' can be attached to the core 42', or it can be an unattached element that is secured in the module 50. In the later case, when the polishing pad 30 and window 36 are secured to the platen 24, the core 42' can slide into the cylindrical space in the interior formed by the coil 42'. In the former case, the coil will end in an electrical connection that can be coupled and or decoupled from the remaining electronics in the polishing system. For example, the coil can be connected to two contact pads, and two leads can extend from the printed circuit board 160. When the polishing pad 30 and window 36 are secured to the platen 24, the contact pads are aligned and engage the leads from the printed circuit board 160.

Figure 5:
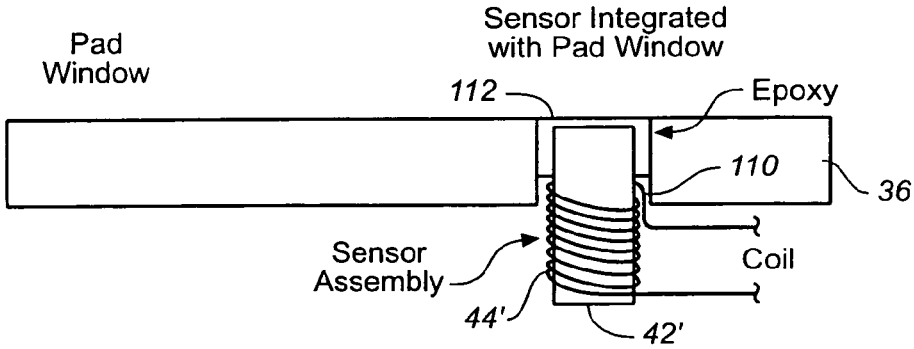
FIG. 5 is a schematic cross-sectional side view illustrating a core secured to a polishing pad with an epoxy plug.

Referring to FIG. 5, in another implementation, the transparent window 36 includes an aperture 110 entirely through its thickness instead of a recess in its bottom surface. The core 42' is secured in the aperture 110 with an polyurethane plug 112. The top surface of the polyurethane plug 112 is flush with the surface of the transparent window 36. The plug 112 covers the top and upper sides of the core 42' so that the core 42' is recessed relative to the surface of the window 36. Again, the coil 44' can be attached to the core 42', or it can be an unattached element that is secured in the module 50.

Figure 6:
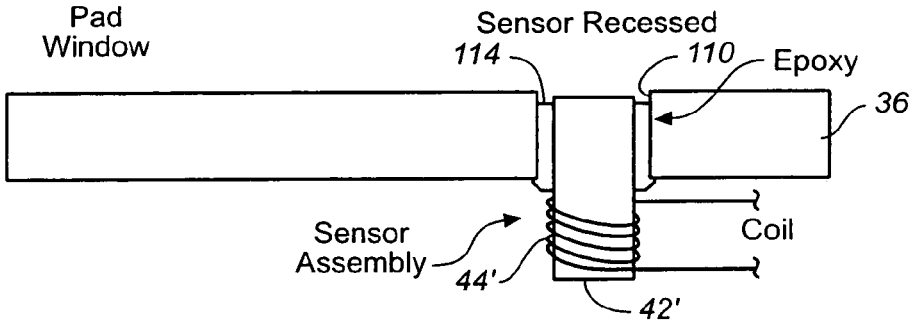
FIG. 6 is a schematic cross-sectional side view illustrating a core secured in an aperture in a polishing pad.

Referring to FIG. 6, in another implementation, the transparent window 36 includes an aperture 110 entirely through its thickness, and the core 42' is secured in the aperture 110 with the top of the core exposed to the environment but slightly recessed below the surface of the window 36. The sides of the core 42' are coated with an polyurethane epoxy 114.

Figure 7:
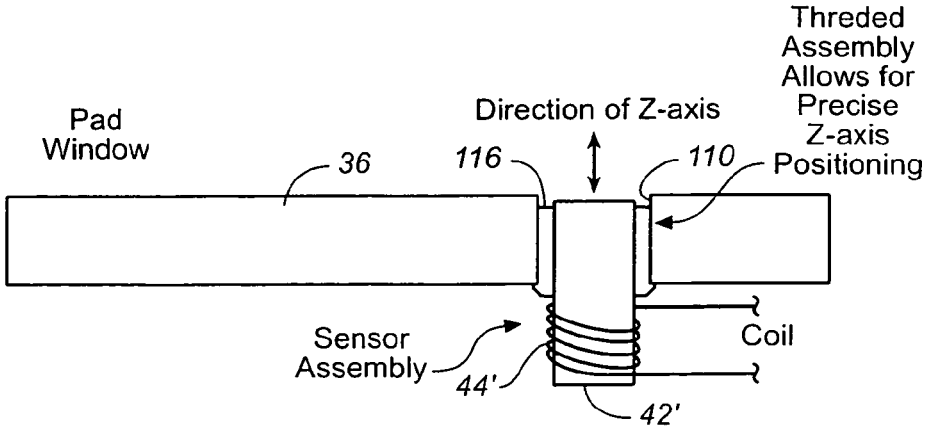
FIG. 7 is a schematic cross-sectional side view illustrating a core secured to a polishing pad with an adjustable vertical position.

Referring to FIG. 7, the position of the core 42' can be vertically adjusted. The transparent window 36 includes an aperture 110 entirely through its thickness. An epoxy cylinder 116 is secured in the aperture 110. The outer surface of the core 42' is threaded or grooved, and the inner surface of the epoxy cylinder has grooves or threads that mate to the outer surface of the core 42'. Thus, the core 42' can be precisely positioned along the Z-axis (an axis perpendicular to the window surface) by rotating the core 42'. This permits the position of the core 42' to be selected so that it does not scratch the substrates being polishing, yet is nearly flush with the top surface of the window 36. In addition, the position of the core 42' can be adjusted as the polishing pad wears, thereby maintaining a uniform distance (on a substrate to substrate basis) between the substrate and core. However, a potential disadvantage is that threads or grooves in the core can concentrate the flux lines, resulting in a bigger spot size.

Figure 8:
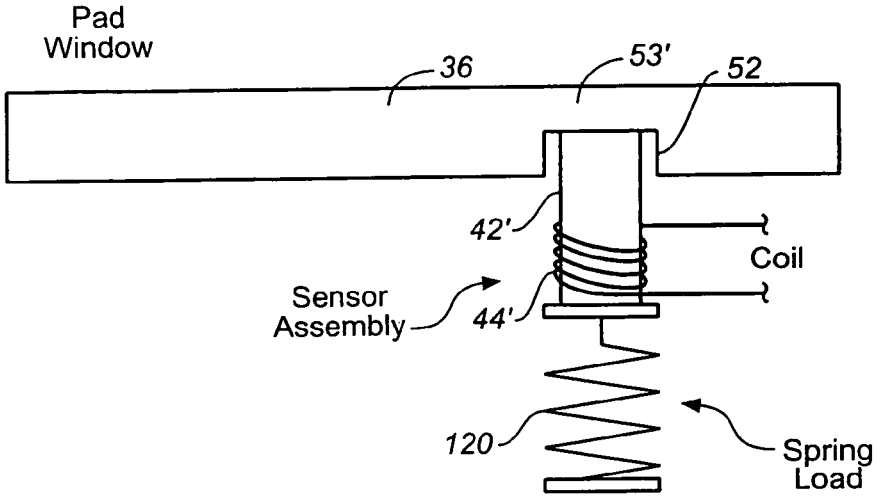
FIG. 8 is a schematic cross-sectional side view illustrating a core urged against a bottom surface of a polishing pad with load spring.

Referring to FIG. 8, in another implementation, the core 42' is urged against the recess 52 of the transparent window 36 with a loading spring 120. Spring 120 can be a very soft spring (low spring constant) and the window need not be supported as well as the rest of the pad. Consequently, during the polish process the shear force and wear rate in the thin section 53' can be lower than the rest of the pad. Another potential advantage of this implementation is that the core 42' can be easily replaced.

Figure 9:
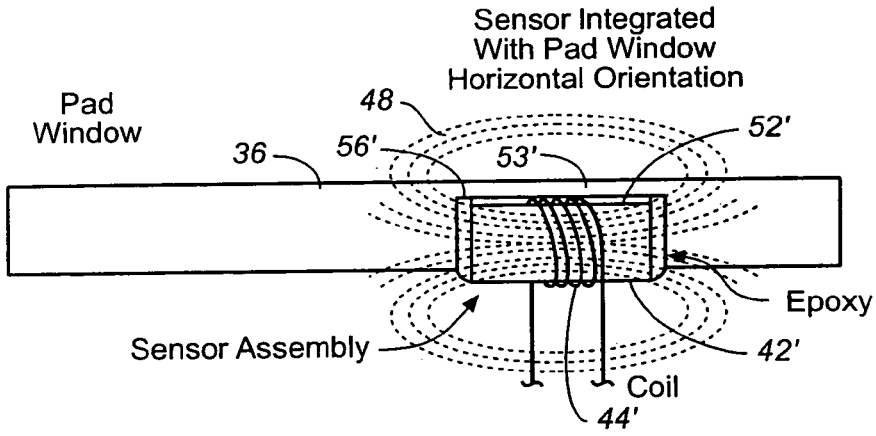
FIG. 9 is a schematic cross-sectional side view illustrating a core secured to a polishing pad in a horizontal orientation.

Referring to FIG. 9, in another implementation, the core 42' is secured in a recess 52' in the transparent window 36 with a horizontal orientation, i.e., the primary magnetic field axis is parallel to the window surface. The core 42' can be aligned axially or radially relative to the rotational axis of the polishing surface, or at an intermediate angle between axial and radial alignment. The core 42' can be secured with an adhesive 56', such as an epoxy. By providing additional orientations for the sensor, the operator has more options for optimizing signal-to-noise or spatial resolution.

Figure 10:
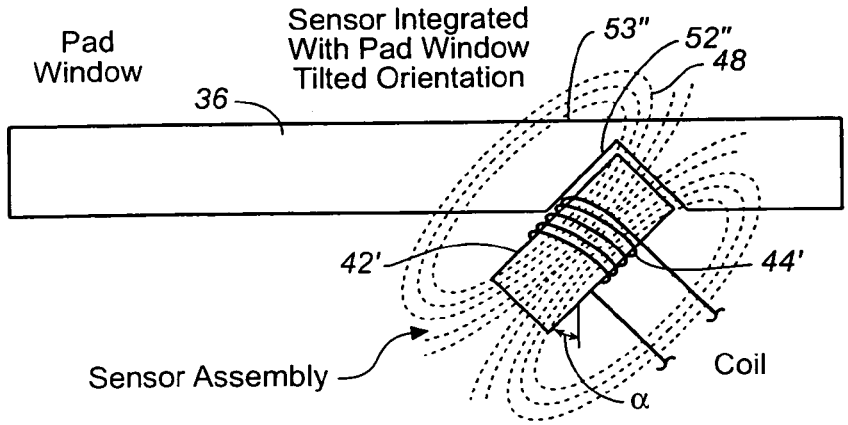
FIG. 10 is a schematic cross-sectional side view illustrating a core secured to a polishing pad in a tilted orientation.

Referring to FIG. 10, in another implementation, the core 42' is tilted at an angle $\alpha$ relative to vertical. The angle $\alpha$ is greater than 0° and less than 90°. For example, the angle $\alpha$ can be 45°. The core 42' is secured in a recess 52" that is shaped to hold the core 42' at the desired angle. The core 42' can be held in place with an adhesive or epoxy, or with some mechanical attachment. The core 42' can be aligned axially or radially relative to the rotational axis of the polishing surface, or at an intermediate angle between axial and radial alignment. By providing additional orientations for the sensor, the operator has more options for optimizing signal-to-noise or spatial resolution.

Figure 11:
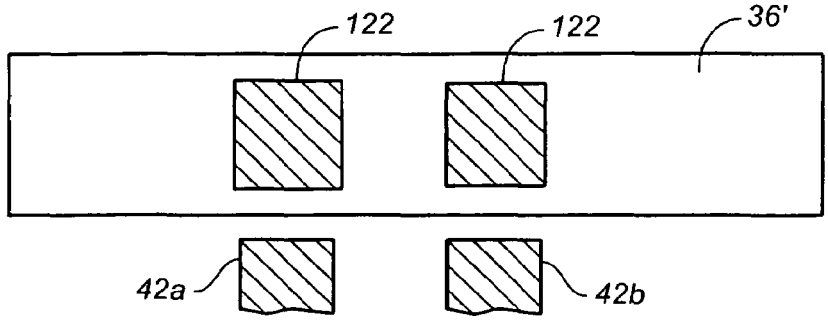
FIG. 11 is a schematic cross-sectional side view illustrating a ferromagnetic piece embedded in the polishing pad.

Referring to FIG. 11, in another implementation, one or more ferromagnetic pieces 122 are actually embedded in the polishing pad or window 36'. For example, the pieces 122 could be ferrite blocks enclosed in polishing window when the window is solidified. When the polishing pad is attached to the platen, the pieces 122 align with the prongs 42*a* and 42*b* of the core 42 to serve as the prong extenders.

Figure 12:
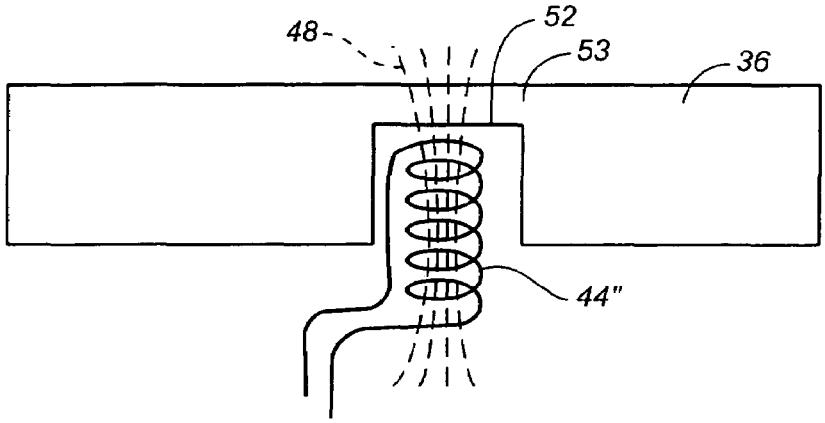
FIG. 12 is a schematic cross-sectional side view illustrating a eddy current monitoring system with a coil that extends into a recess in the polishing pad.

Referring to FIG. 12, in another implementation, the eddy current monitoring system 40 does not include a core, but has only a coil 44". The polishing pad 36 includes a recess 52 formed in a bottom surface of the window 36. When the polishing pad is secured to the platen, the window 36 is aligned so that the coil 44" extends into the recess 52. This implementation may be practical if the coil 44" operates at high frequencies.

Figure 13:
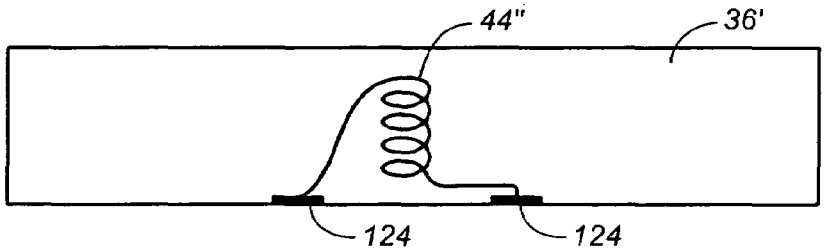
FIG. 13 is a schematic cross-sectional side view illustrating a eddy current monitoring system with a coil that is embedded in the polishing pad.

Referring to FIG. 13, in another implementation that also lacks a core, the coil 44" is actually embedded in the polishing pad or window 36'. The coil 44" is connected to two electrical contact pads 124. When the polishing pad 36' is secured to the platen 24, the contact pads 124 are aligned with and engage leads from the eddy current monitoring system 40 to complete the electrical circuit.

Figure 14A:
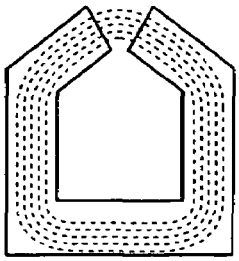
FIGS. 14A-14C are side views illustrating horseshoe shaped cores.
Figure 14B:
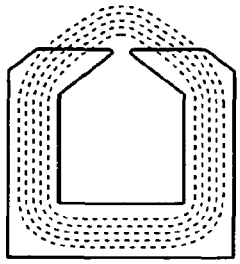
Figure 14C:
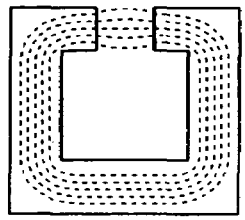

Referring to FIGS. 14A-14C, the eddy current monitoring system can use other core shapes, such as horseshoe shaped cores 130, 132 or 136. By providing additional core shapes, the operator has more options for optimizing signal-to-noise or spatial resolution. In particular, the horseshoe shaped cores of FIGS. 14A-14C have short distances between the opposing prongs. Consequently, the magnetic field should spread only a short distance from the ends of the prongs. Thus, the horseshoe shaped cores can provide improved spatial resolution.

Figure 1B:
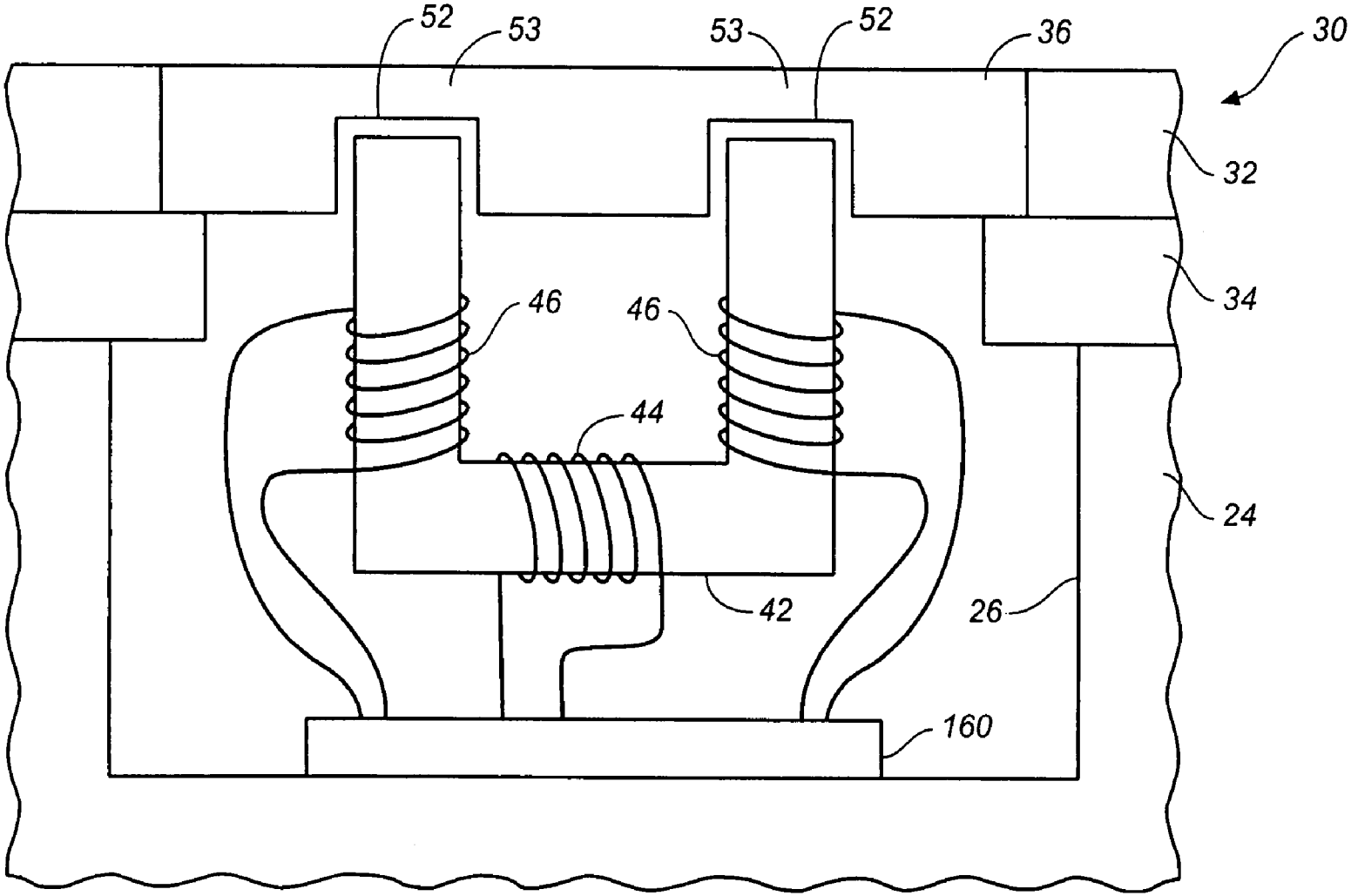
FIG. 1B is an enlarged view of the eddy current monitoring system of FIG. 1.

Returning to FIG. 1, a general purpose programmable digital computer 90 can be coupled to the components in the platen, including printed circuit board 160, through a rotary electrical union 92. The computer 90 receives the signals from the eddy current sensing system and the optical monitoring system. Since the monitoring systems sweep beneath the substrate with each rotation of the platen, information on the metal layer thickness and exposure of the underlying layer is accumulated in-situ and on a continuous real-time basis (once per platen rotation). As polishing progresses, the reflectivity or thickness of the metal layer changes, and the sampled signals vary with time. The time varying sampled signals may be referred to as traces. The measurements from the monitoring systems can be displayed on an output device 94 during polishing to permit the operator of the device to visually monitor the progress of the polishing operation. In addition, as discussed below, the traces may be used to control the polishing process and determine the end-point of the metal layer polishing operation.

In operation, CMP apparatus 20 uses eddy current monitoring system 40 and optical monitoring system 140 to determine when the bulk of the filler layer has been removed and to determine when the underlying stop layer has been substantially exposed. The computer 90 applies process control and endpoint detection logic to the sampled signals to determine when to change process parameter and to detect the polishing endpoint. Possible process control and endpoint criteria for the detector logic include local minima or maxima, changes in slope, threshold values in amplitude or slope, or combinations thereof.

The eddy current and optical monitoring systems can be used in a variety of polishing systems. Either the polishing pad, or the carrier head, or both can move to provide relative motion between the polishing surface and the substrate. The polishing pad can be a circular (or some other shape) pad secured to the platen, a tape extending between supply and take-up rollers, or a continuous belt. Terms of vertical positioning are used, but it should be understood that the polishing surface and substrate could be held in a vertical orientation or some other orientation. The polishing pad can be affixed on a platen, incrementally advanced over a platen between polishing operations, or driven continuously over the platen during polishing. The pad can be secured to the platen during polishing, or there could be a fluid bearing between the platen and polishing pad during polishing. The polishing pad can be a standard (e.g., polyurethane with or without fillers) rough pad, a soft pad, or a fixed-abrasive pad.

Although illustrated as positioned in the same hole, optical monitoring system 140 could be positioned at a different location on the platen than eddy current monitoring system 40. For example, optical monitoring system 140 and eddy current monitoring system 40 could be positioned on opposite sides of the platen, so that they alternately scan the substrate surface. Moreover, the invention is also applicable if no optical monitoring system is used and the polishing pad is entirely opaque. In these two cases, the recesses or apertures to hold the core are formed in one of the polishing layers, such as the outermost polishing layer of the two-layer polishing pad.

The eddy current monitoring system can include separate drive and sense coils, or a single combined drive and sense coil. In a single coil system, both the oscillator and the sense capacitor (and other sensor circuitry) are connected to the same coil.

A number of embodiments of the invention have been described. Nevertheless, it will be understood that various modifications may be made without departing from the spirit and scope of the invention. Accordingly, other embodiments are within the scope of the following claims.

What is claimed is:

1. A polishing pad, comprising:

a polishing layer;

a transparent window in the polishing layer, wherein the window has a recess formed in a bottom surface thereof; and a ferromagnetic body having an upper portion in the recess of the window and secured to the window with an adhesive and a lower portion below the bottom surface of the window, wherein a coil is wound around the ferromagnetic body.

2. The polishing pad of claim 1, wherein the window includes a plurality of recesses formed in a bottom surface thereof, and a plurality of ferromagnetic bodies are positioned into the recesses.

3. The polishing pad of claim 1, wherein the polishing pad further comprises a backing layer.

4. The polishing pad of claim 1, wherein a position of the ferromagnetic body relative to a surface of the polishing layer is adjustable.

5. The polishing pad of claim 1, wherein the ferromagnetic body is positioned with a longitudinal axis perpendicular to a surface of the polishing layer.

6. The polishing pad of claim 1, wherein the ferromagnetic body is positioned with a longitudinal axis at an angle greater than 0 and less than 90 degrees to a surface of the polishing layer.

7. The polishing pad of claim 1, wherein the ferromagnetic body is secured to the window with an epoxy.

8. The polishing pad of claim 1, wherein the window is a polymer.

9. The polishing pad of claim 8, wherein the transparent window has a top surface that is flush with a polishing surface of the polishing layer.

10. The polishing pad of claim 1, wherein the coil is positioned below the window.

11. The polishing pad of claim 1, wherein the ferromagnetic body projects below a bottom surface of the window.

12. The polishing pad of claim 1, wherein the ferromagnetic body is completely enclosed in the window.

13. The polishing pad of claim 1, wherein the body is a rod and the coil wraps around the body but is unattached to the body.

14. The polishing pad of claim 13, wherein the coil includes electrical connections configured to be coupled to contact pads.

15. The polishing pad of claim 1, wherein the body is a rod and the coil wraps around the body and is attached to the body.

16. The polishing pad of claim 1, wherein the body is a rod and the coil wraps around the body outside of the recess and epoxy surrounds the body in the recess.

17. The polishing pad of claim 16, wherein the rod is a cylinder.

18. The polishing pad of claim 16, wherein the rod is a trapezoid.

* * * * *